US011221128B1

(12) United States Patent
Winters et al.

(10) Patent No.: US 11,221,128 B1
(45) Date of Patent: Jan. 11, 2022

(54) LOW PROFILE DOWNLIGHT WITH TRIM RING

(71) Applicant: American Lighting, Inc., Denver, CO (US)

(72) Inventors: Philip Winters, Denver, CO (US); Jennifer Barry, Wheat Ridge, CO (US); Jason Elrod, Castle Rock, CO (US)

(73) Assignee: American Lighting, Inc., Denver, CO (US)

( * ) Notice: Subject to any disclaimer, the term of this patent is extended or adjusted under 35 U.S.C. 154(b) by 0 days.

(21) Appl. No.: 17/119,809

(22) Filed: Dec. 11, 2020

(51) Int. Cl.

| | |
|---|---|
| ***F21V 17/06*** | (2006.01) |
| ***F21S 8/02*** | (2006.01) |
| ***F21Y 105/18*** | (2016.01) |
| ***F21Y 115/10*** | (2016.01) |

(52) U.S. Cl.
CPC ..... *F21V 17/06* (2013.01); *F21S 8/026* (2013.01); *F21Y 2105/18* (2016.08); *F21Y 2115/10* (2016.08)

(58) Field of Classification Search
None
See application file for complete search history.

(56) References Cited

U.S. PATENT DOCUMENTS 6,830,362 B2 * 12/2004 Mullen ..... F21V 17/164 362/455
7,631,993 B2 * 12/2009 Russello ..... F21V 17/14 362/362
8,033,683 B2 10/2011 Fields
8,240,880 B2 8/2012 Chen et al.
8,430,524 B2 4/2013 Chen et al.
8,454,204 B1 6/2013 Chang et al.
8,882,311 B2 * 11/2014 Snell ..... F21S 8/026 362/374
9,010,956 B1 4/2015 Snell
9,127,824 B2 9/2015 Zhang et al.
9,157,611 B2 10/2015 Kim et al.
9,228,709 B2 1/2016 Hatch
9,464,778 B2 10/2016 Yuan et al.
9,797,585 B2 10/2017 Leshniak et al.
10,036,545 B2 7/2018 Huang
10,072,835 B2 9/2018 Maxik et al.
10,422,518 B2 9/2019 Myers et al.
10,429,042 B2 10/2019 Feit et al.
10,488,000 B2 11/2019 Danesh et al.
(Continued)

*Primary Examiner* — Britt D Hanley
(74) *Attorney, Agent, or Firm* — Michael M. McGaw; McGaw Law, P.C.

(57) ABSTRACT

A low profile lighting device for installation on a flat surface such as a ceiling. The low profile down light can have a housing comprising a generally planar surface and a sidewall rising from the planar surface; a PCB with a plurality of LEDs affixed to the generally planar surface of the housing; a lens in contact with the sidewall of the housing and having a first side facing the LEDs on the PCB such that light from the LED illuminates the first side of the lens; and a trim ring adapted to slide over the housing and having a first end and a second end opposite the first end, wherein the first end has a plurality of tabs adapted to secure the trim ring to a housing and the second end has an inwardly projecting lip adapted to contact the second side of the lens thereby securing the lens to the housing.

11 Claims, 10 Drawing Sheets

(56) References Cited

U.S. PATENT DOCUMENTS

| | | | | |
|---|---|---|---|---|
| 10,663,127 | B2 * | 5/2020 | Danesh | F21K 9/68 |
| 11,067,232 | B2 * | 7/2021 | Nijkamp | G02B 6/005 |
| 2005/0237746 | A1 * | 10/2005 | Yiu | F21V 29/83 362/294 |
| 2007/0253204 | A1 * | 11/2007 | Akinrele | F21V 15/04 362/362 |
| 2008/0192489 | A1 | 8/2008 | Ward | |
| 2011/0285314 | A1 | 11/2011 | Carney et al. | |
| 2012/0268688 | A1 | 10/2012 | Sato et al. | |
| 2013/0322062 | A1 * | 12/2013 | Danesh | F21V 21/04 362/157 |
| 2015/0176823 | A1 | 6/2015 | Leshniak et al. | |
| 2015/0204491 | A1 | 7/2015 | Yuan et al. | |
| 2017/0314776 | A1 | 11/2017 | Huang | |
| 2018/0347801 | A1 | 12/2018 | O'Brien et al. | |
| 2020/0340635 | A1 * | 10/2020 | Boulanger | H05B 45/37 |
| 2021/0080084 | A1 * | 3/2021 | Danesh | F21V 17/002 |

* cited by examiner

LOW PROFILE DOWNLIGHT WITH TRIM RING

FIELD OF INVENTION

The present invention pertains to light fixtures. More particularly the present invention pertains to low-profile light fixtures designed to be mounted flush to a surface such as a ceiling or a wall.

BACKGROUND OF THE INVENTION

In recent years, widespread interest has been seen for replacing incandescent light bulbs with lighting fixtures that employ more efficient lighting technologies. One such technology that shows tremendous promise employs light emitting diodes (LEDs). Compared with incandescent bulbs, LED-based light fixtures are much more efficient at converting electrical energy into light and are longer lasting. As a result, lighting fixtures that employ LED technologies are expected to replace incandescent bulbs in residential, commercial, and industrial applications. Many of these lighting fixtures employ an array of LEDs, which emit light that is directed through a lens. One benefit of the LED-based lighting devices, especially ones employing an array of LEDs, is their ability to adopt layouts and fit into spaces that were not possible with standard incandescent bulbs. For example, LED-based lighting devices can be made that are especially compact and blend into a space such as a ceiling. This compact size can make assembly and installation of the lights more complicated. The present invention addresses some of the issues with the assembly and installation of lights as will become apparent in the following disclosure.

SUMMARY OF THE INVENTION

The present invention provides a low profile lighting device for installation on a flat surface such as a ceiling.

In a first aspect the present invention provides a low profile downlight. The low profile down light according to the first aspect can have a housing comprising a generally planar surface and a sidewall rising from the planar surface; a PCB with a plurality of LEDs affixed to the generally planar surface of the housing; a lens in contact with the sidewall of the housing and having a first side facing the LEDs on the PCB such that light from the LED illuminates the first side of the lens; and a trim ring adapted to slide over the housing and having a first end and a second end opposite the first end, wherein the first end has a plurality of tabs adapted to secure the trim ring to a housing and the second end has an inwardly projecting lip adapted to contact the second side of the lens thereby securing the lens to the housing.

In an advantageous embodiment the trim ring has a generally cylindrical shape. The outer diameter of the lens can be less than the inner diameter of the cylindrical section of the trim ring and greater than the diameter of the inner edge of the inwardly projecting lip. In further advantageous embodiments the low profile downlight according to the first aspect has tabs constructed from a bendable metal that allows the trim ring to releasably engage the housing. The plurality of LEDs on the PCB can be arranged in a series of concentric circles on the PCB. Further, the diameter of the trim ring can be between about 4 inches to about 6 inches (e.g. about 4 inches, about 5 inches, about 6 inches). In addition, the depth of the trim ring excluding the tabs can be less than about 4 cm, less than about 3 cm, less than about 2 cm or less than about 1.5 cm. Advantageously, the depth is less than 1.5 cm. In further advantageous embodiments, the depth of the trim ring excluding the tabs is slightly greater than the combined depth of the edge of the lens and the housing sidewall. The low profile downlight according to the first aspect can also include a mounting plate adapted to be affixed to an opening of a planar surface and two or more mounting clips that releasably engage the mounting plate. In still further advantageous embodiments of the low profile lighting device according to the first aspect, the trim ring can have a thickness less than about 1 mm.

In a second aspect the present invention provides a second low profile downlight. The low profile down light according to the second aspect can have a housing comprising a generally planar surface and a sidewall rising from the planar surface defining the outer periphery of the housing; a PCB with a plurality of LEDs affixed to the generally planar surface of the housing; a lens in contact with the sidewall of the housing and having a first side facing the LEDs on the PCB such that light from the LED illuminates the first side of the lens and an outer periphery wherein the dimensions of the other periphery of the lens are approximately equal to the dimensions of the other periphery of the housing and wherein the lens matingly engages a complementary surface on the housing; and a trim ring adapted to slide over the housing and having a first end and a second end opposite the first end, wherein the first end has a plurality of tabs adapted to secure the trim ring to the housing and the second end has an inwardly projecting lip adapted to contact the second side of the lens thereby securing the lens to the housing.

In a third aspect the present invention provides a trim ring for a low profile downlight. The trim ring can include a cylindrical body adapted to slide over a light housing and having a first end and a second end opposite the first end, wherein the first end has a plurality of tabs adapted to secure the trim ring to a housing and the second end has an inwardly projecting lip adapted to secure a lens to a housing.

In an advantageous embodiment the trim ring for a low profile downlight can have a cylindrical body that is substantially circular. The tabs can advantageously be constructed from a bendable metal to facilitate the locking and release of the trim ring to the housing. The depth of the trim ring excluding the tabs can be less than about 4 cm, less than about 3 cm, less than about 2 cm or less than about 1.5 cm. Advantageously, the depth of the trim ring excluding the tabs is less than about 1.5 cm. The diameter of the trim ring can be between about 4 inches to about 6 inches.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
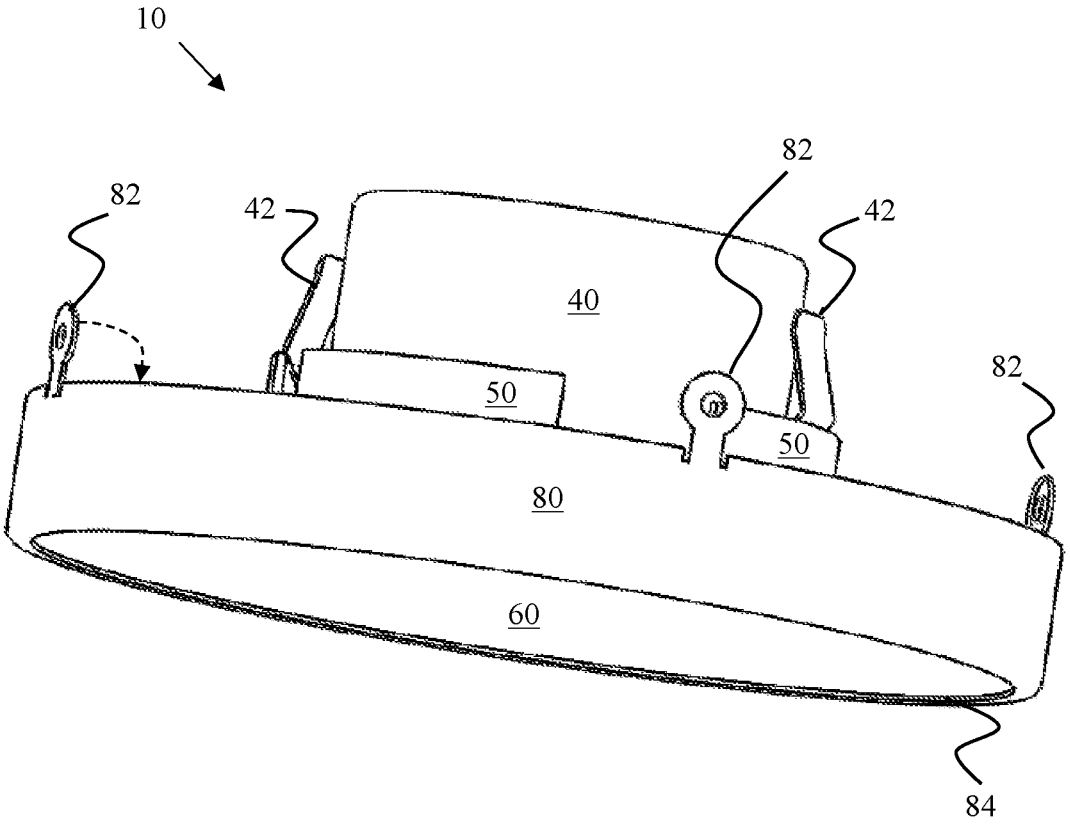
FIG. 1 is drawing showing an isometric view of the side of the lighting fixture according to one embodiment of the invention.
Figure 2:
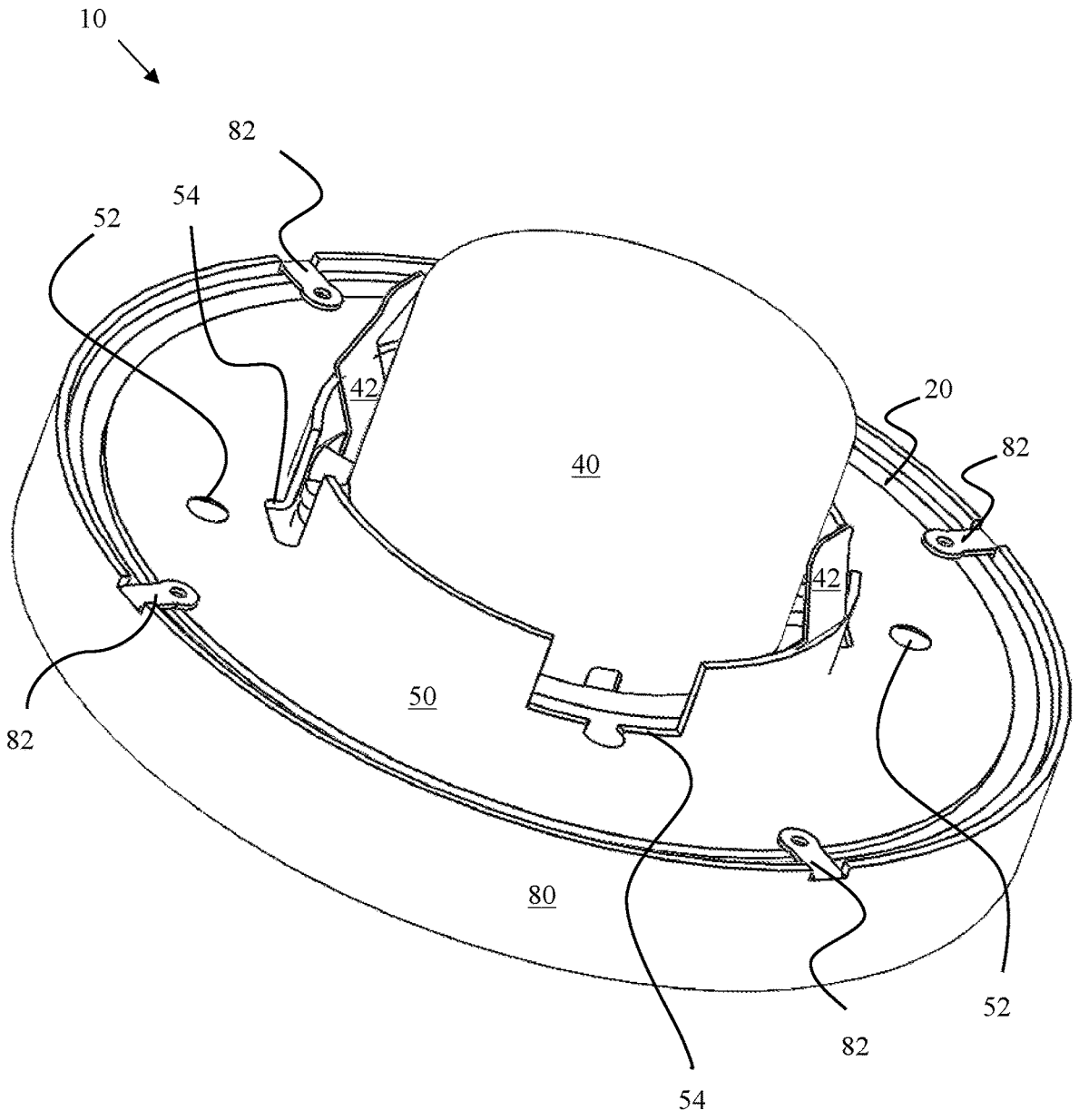
FIG. 2 is drawing showing an isometric view of the back of the lighting fixture shown in FIG. 1.

The present invention provides a lighting and housing assembly for a solid-state lighting (SSL) fixture. With reference to FIGS. 1 and 2, a lighting fixture 10 is illustrated according to one embodiment of the present disclosure. While the lighting fixture 10 in this embodiment is illustrated for reference, those skilled in the art will recognize that virtually any type of solid-state lighting fixture may benefit from the subject lighting assembly and the concepts embodied therein.

As shown in FIG. 1, the lighting fixture 10 includes a housing 20 (not shown in FIG. 1, but shown more fully in FIGS. 4 and 6-9), a control module cover 40, a mounting plate 50, a lens 60 and a trim ring 80. The trim ring 80 fits over the sides of the housing 20 and the edge of the circular lens 60. The trim ring 80 has four trim ring tabs 82 (one of the four trim ring tabs is not visible in FIG. 1) that affix the trim ring 80 to the back of the housing 20, thereby securing lens 60 within the light fixture 10. The trim ring tabs 82 shown in FIG. 1 are in the extended position. The trim ring 80, including the trim ring tabs 82, can be made of flexible or bendable material, such as a thin metal. When the trim ring tabs 82 are in the extended position the trim ring 80 can be removed from the housing 20 to release the trim ring 80 and the lens 60 from the housing 20. Alternatively, the trim ring tabs 82 are can be bent or folded 90 degrees to contact the base or backside of the housing and secure the trim ring 80 and the lens 60 to the housing 20 as shown in FIG. 2.

The trim ring 80 has an inwardly projecting lip, or trim ring lip 84, at the edge of the trim ring opposite the trim ring tabs 82 (see e.g. FIG. 1). The inner diameter of the trim ring lip 84 is smaller than the outer diameter of the lens 60. In contrast, the body of the trim ring 80 has a diameter that is just slightly greater than the diameter of the lens 60. The differential diameter between the body of the trim ring 80 and the trim ring lip 84, with the diameter of the lens 60 falling between the two diameters, allows the trim ring 80 to secure the lens 60 to the housing 20 when the trim ring 80 is affixed to the housing 20.

FIG. 2 shows an alternative view of the lighting fixture 10 shown in FIG. 1. In particular, FIG. 2 shows the reverse side of the lighting fixture shown in FIG. 1. The lighting fixture 10 shown in FIG. 2 includes a housing 20, a control module cover 40, a mounting plate 50, a lens 60 (not visible in FIG. 2) and a trim ring 80. The view of the housing 20 is largely obscured by the mounting plate 50 and the trim ring 80.

Figure 3:
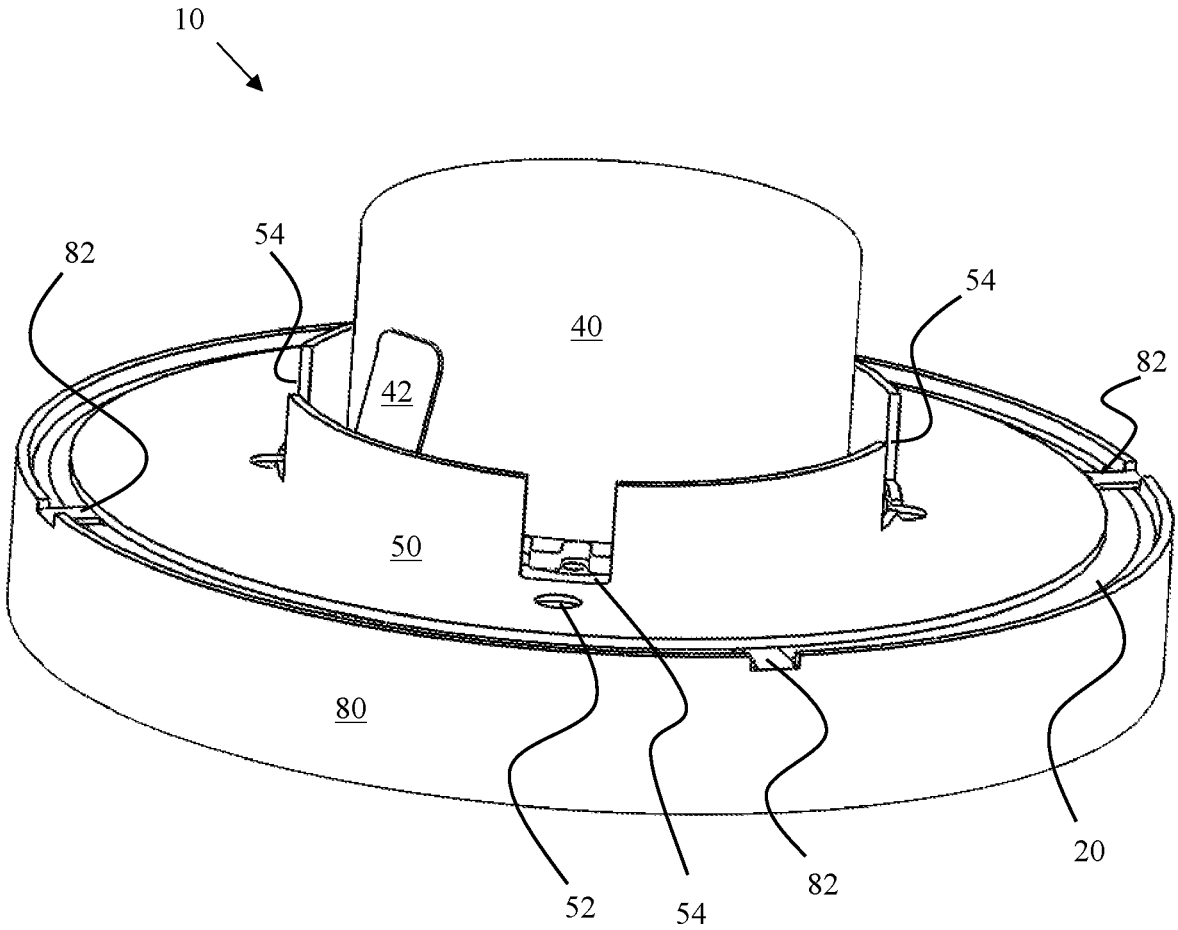
FIG. 3 is drawing showing an isometric view of the back of the lighting fixture shown in FIG. 1.
Figure 4:
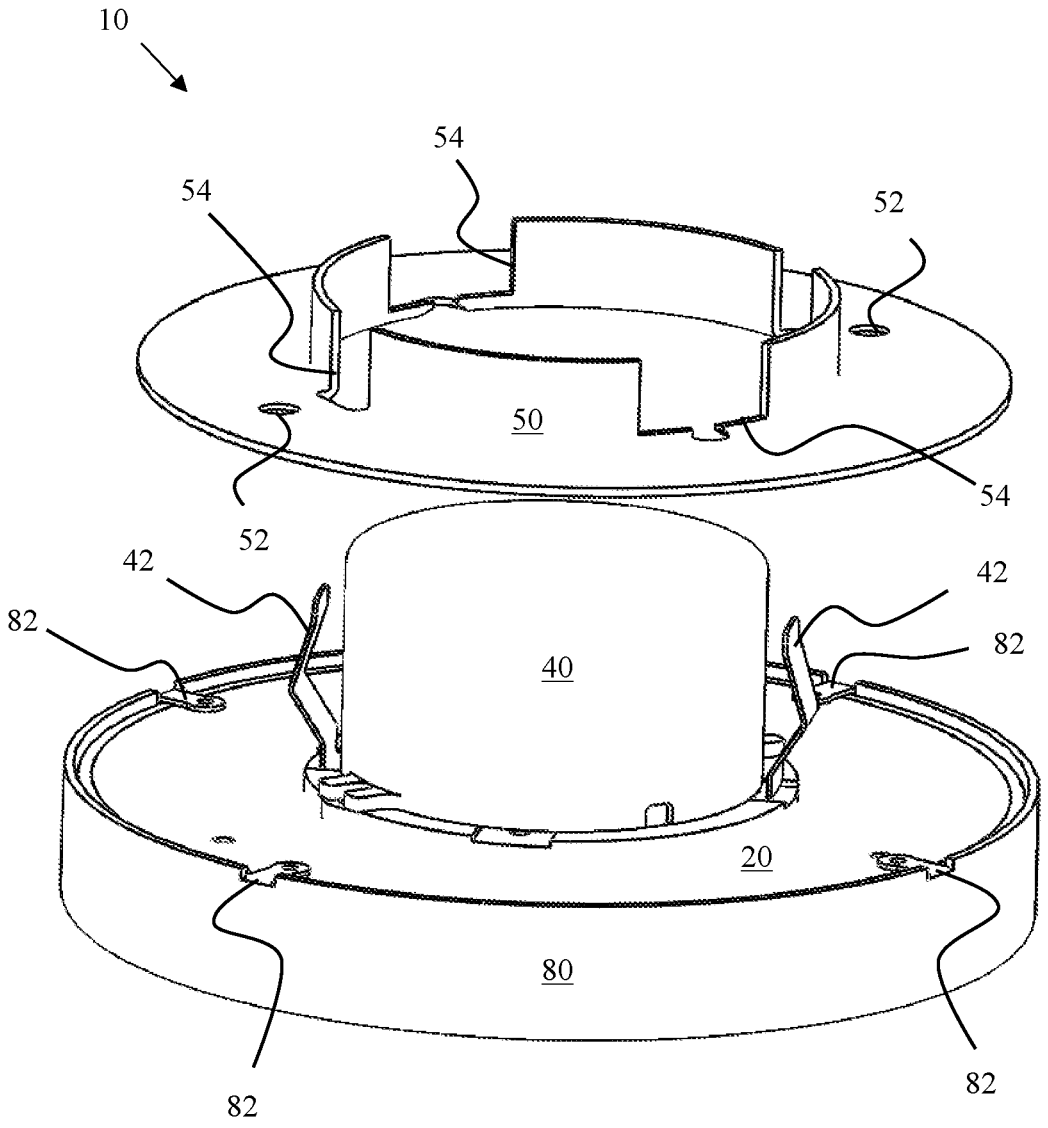
FIG. 4 is drawing showing an isometric view of the back of the lighting fixture shown in FIG. 1.

The trim ring 80 includes four trim ring tabs 82 that affix the trim ring 80 to the housing 20, thereby affixing lens 60 to the light fixture 10. The trim ring tabs 82 shown in FIG. 2 are in the folded position, with the trim ring tabs 82 contacting the mounting plate 50. The trim ring tabs 82 are illustrated in this manner to display the folded trim ring tabs 82. In practice, the folded trim ring tabs 82 would be sandwiched between the mounting plate 50 and the housing 20, and in contact with the housing 20 as shown in FIG. 3.

Figure 5:
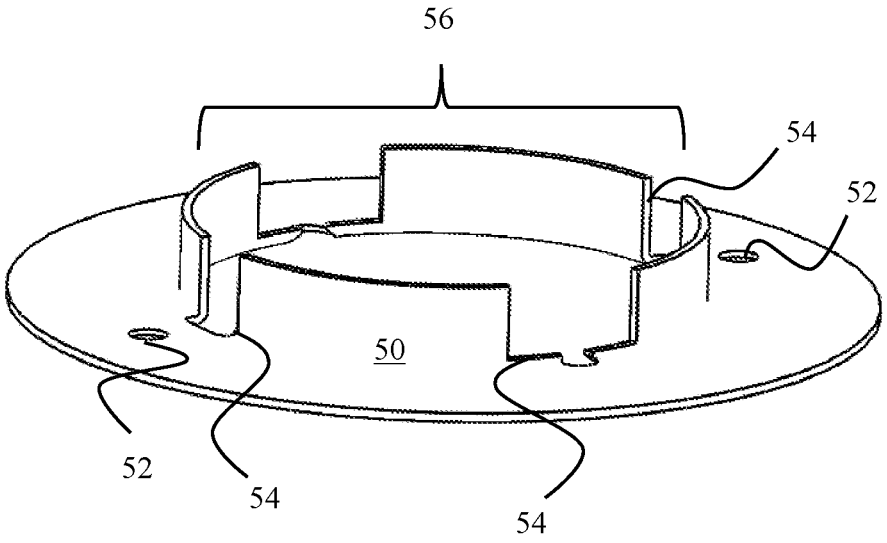
FIG. 5 is drawing showing an isometric view of the mounting plate of the lighting fixture shown in FIG. 1.
Figure 6:
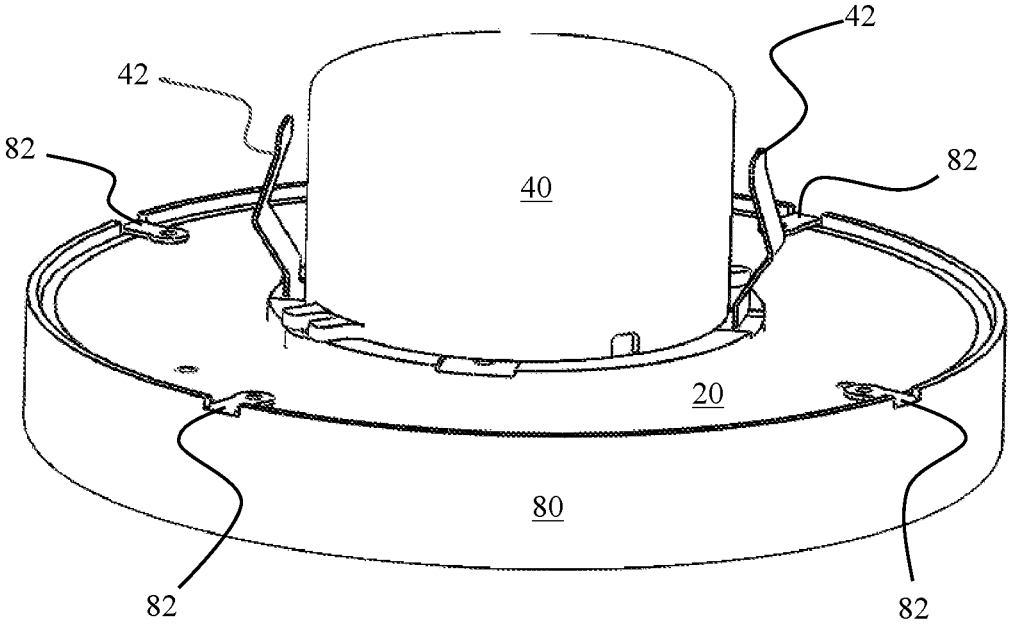
FIG. 6 is drawing showing an isometric view of the lighting fixture shown in FIG. 1 without the mounting plate.

The mounting plate 50 is shown to have a central opening (see e.g. central opening 56 in FIG. 5) through which the control module cover 40 is inserted. The mounting plate 50 is further shown to have a pair of mounting holes 52 designed to receive a screw in each mounting hole 52, thereby enabling the mounting plate 50 to be securely mounted in an opening of a ceiling to facilitate the mounting of the lighting fixture 10 on a ceiling.

The lighting fixture 10 as shown in FIG. 2 includes a pair of mounting dips 42 affixed to the control module cover 40 (see e.g. FIG. 7) and a mounting plate 50. To install the light in the opening of a ceiling, the mounting plate 50 is separated from the remainder of the light fixture (see e.g. FIG. 4). The mounting plate 50 can then be attached to the area immediately surrounding the opening of a ceiling, such as by attachment using a plurality of screws to match the number of mounting holes 52 in the mounting plate 50. The remainder of the lighting fixture can then be reattached by insertion of the control module cover 40 into a central opening in the mounting plate 50, with the mounting clips 42 holding the light fixture in the mounting plate 50 thereby attaching the light fixture 10 to the ceiling. In particular, the mounting clips 42 are inserted through the mounting slots 54 of the mounting plate 50 until the insertion limit is reached. The portion of the lighting fixture 10 with the mounting clips 42 is then rotated along a horizontal plane with respect to a ceiling to move the mounting clips 42 out of the mounting slots 54 and secure the lighting fixture 10 in the ceiling.

A light source (not shown), which will be described in further detail below, is mounted inside the housing 20 and oriented such that light is emitted from the housing through the lens 60. The electronics (not shown) that are required to power and drive the light source are provided, at least in part, by the control module. While the lighting fixture 10 is envisioned to be used predominantly in 4, 5, and 6-inch recessed lighting applications for industrial, commercial, and residential applications, those skilled in the art will recognize that the concepts disclosed herein are applicable to virtually any size and lighting application.

The lens 60 may include one or more lenses that are made of clear or transparent materials, such as polycarbonate or acrylic glass or any other suitable material. The lens 60 may be associated with a diffuser for diffusing the light emanating from the light source and exiting the housing 20 via the lens 60. Further, the lens 60 may also be configured to shape or direct the light exiting the housing 20 via the lens 60 in a desired manner.

Figure 7:
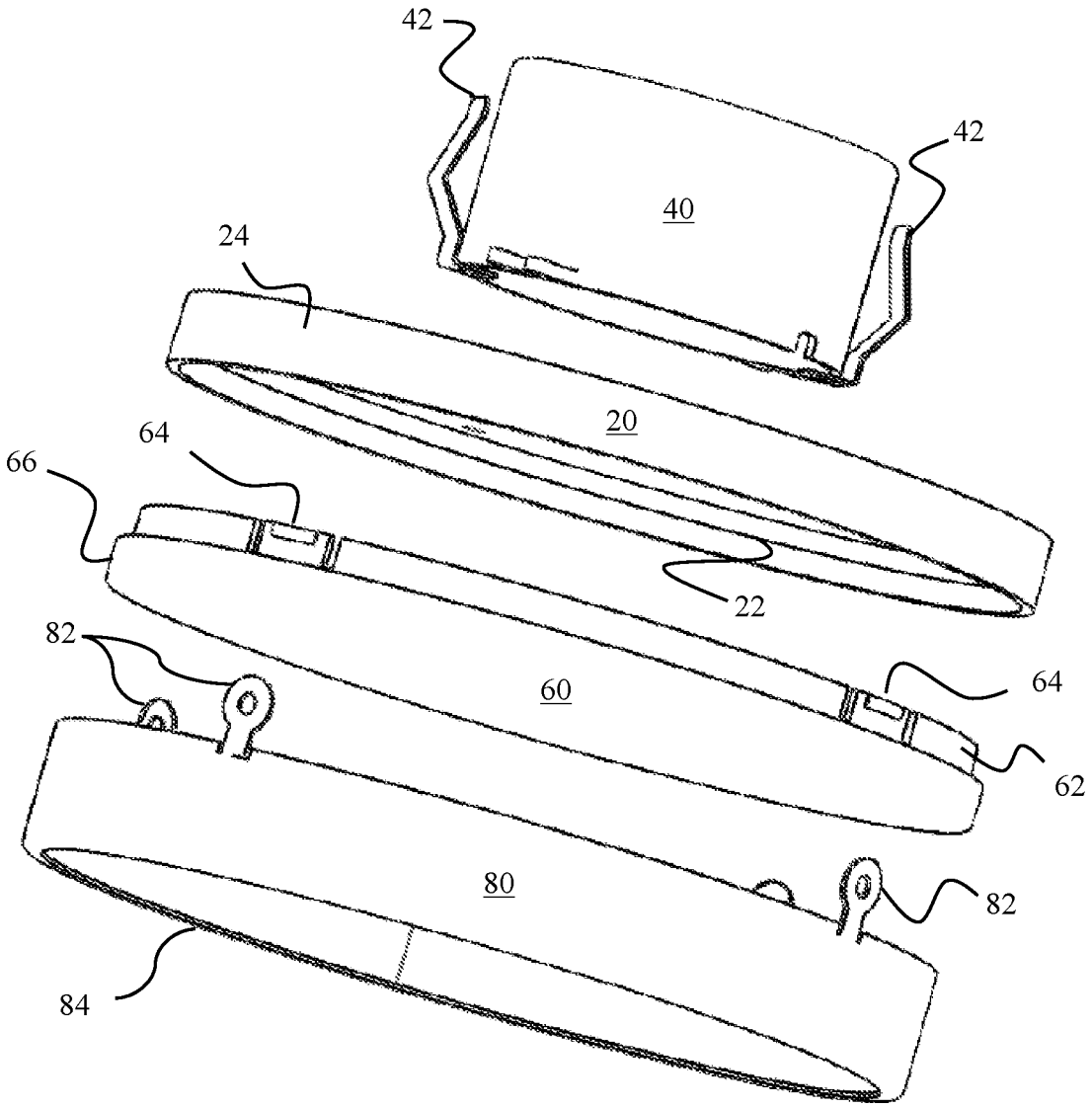
FIG. 7 is drawing showing an exploded isometric side view of the lighting fixture shown in FIG. 1 without the mounting plate.
Figure 8:
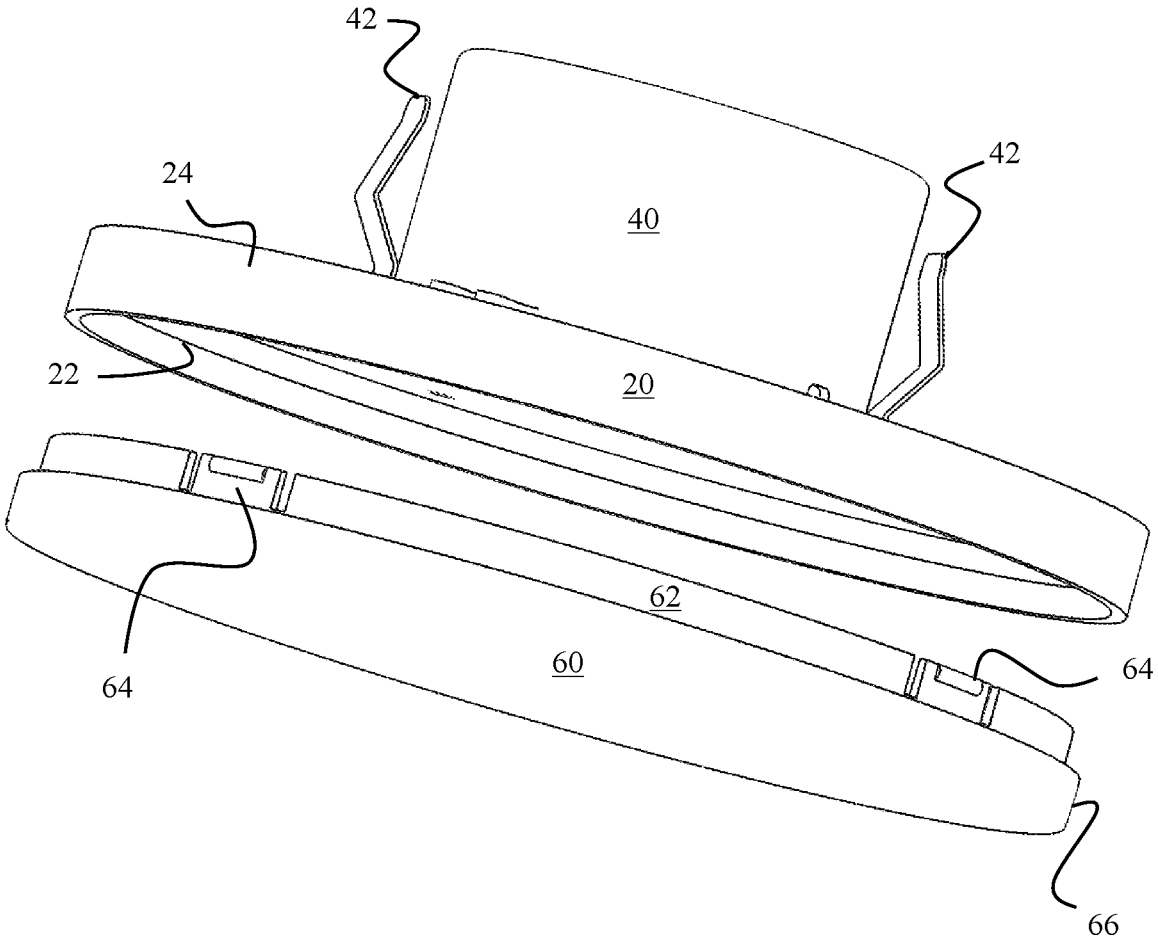
FIG. 8 is drawing showing an exploded isometric side view of the lighting fixture shown in FIG. 1 without the trim ring and the mounting plate.
Figure 9:
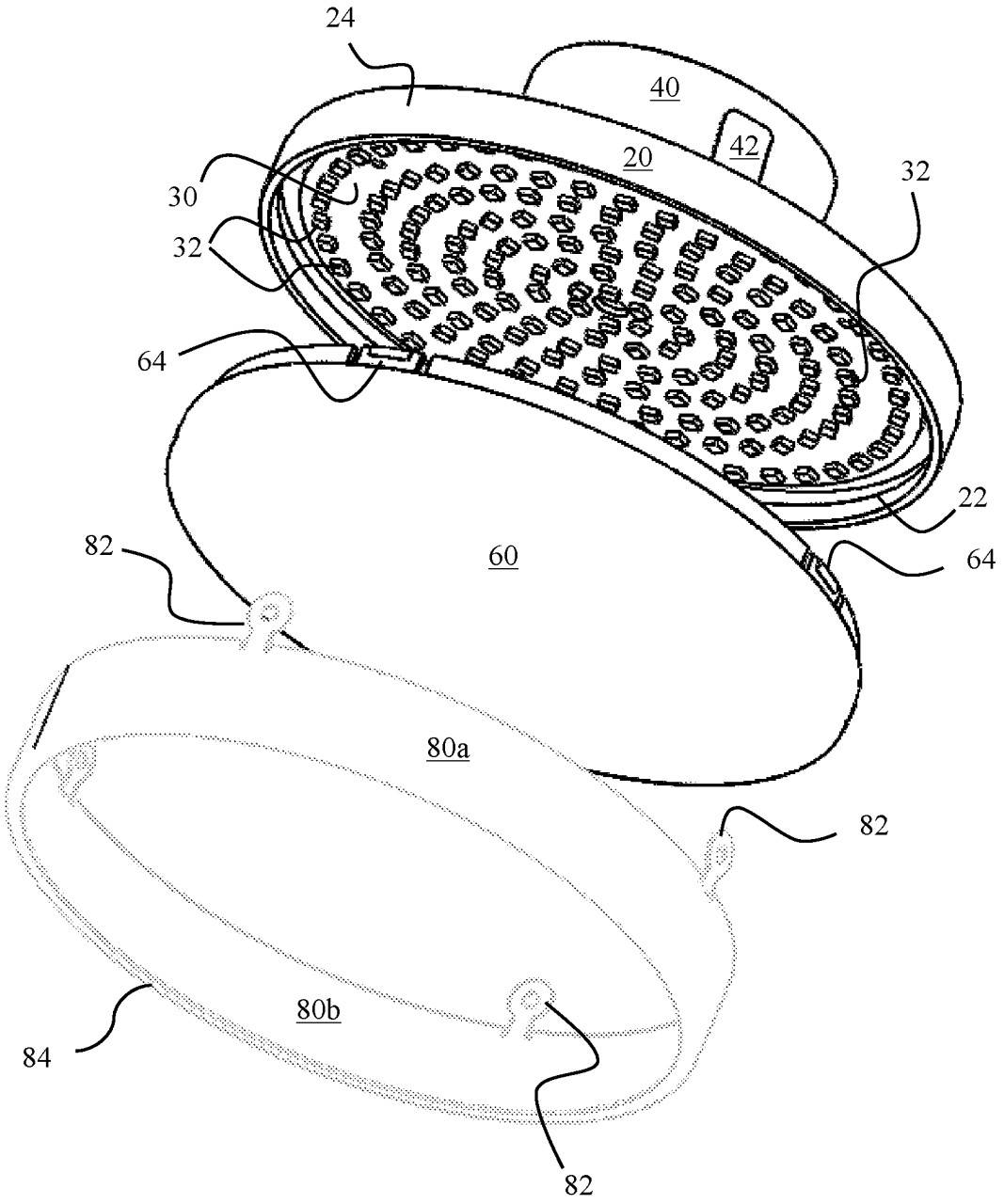
FIG. 9 is drawing showing an exploded isometric front view of the lighting fixture shown in FIG. 1 without the mounting plate.

With reference to FIGS. 7-9, the illustrated lighting device 10 can be seen to include a housing 20 substantially planar surface upon which the PCB 30 is mounted and sidewalls 24 rising from the substantially planar surface of the housing 20. Furthermore, the lens 60 can be seen to have an outer periphery 66 that is roughly co-extensive with the outer periphery of the sidewall 24 of the housing 20.

The inner diameter **80*b* of the trim ring 80 is slightly greater than the outer periphery 66 (i.e. outer diameter) of the lens 60 and the sidewall 24 of the housing 20, allowing the trim ring to slide over the lens and housing and lock in place when the trim ring tabs 82 are bent onto the rear planar surface (i.e. the opposite surface from which the PCB board is mounted) of the housing 20. Once installed in this manner, the trim ring lip 84 prevents the lens 60 from disengaging from the housing 20**.

With reference to FIG. 8, the lens 60 can be seen to have an inner rim 62 whose outer diameter is less than the diameter of the outer periphery 66 of the lens 60. Inner rim 62 fits within the inside of the sidewall 24 of the housing 20. Specifically, inner rim 62 is matingly received with the inner wall of the sidewall 24. The lens further includes a set of lens tabs 64 that reversably engage slot 22 on the inner surface of the sidewall 24 of the housing 20, thereby ensuring a tighter fit between the lens 60 and the housing 20.

In the illustrated embodiment as shown in FIG. 9, the lighting fixture 10 is solid-state and employs one or more light emitting diodes 32 (LEDs) and associated electronics (not shown), which are mounted to a printed circuit board 30 (PCB) to generate light at a desired intensity and color temperature. The LEDs 32 are mounted on the front side of the PCB 30, while the rear side of the PCB 30 is mounted to the front surface of the housing 20 directly or via a thermally conductive pad (not shown). The LEDs 32 are arranged as a series of concentric rings of LEDs 32, however other configurations are possible and contemplated. Concentric rings of equally spaced LEDs (e.g. equally spaced within a ring of LEDs and between concentric rings of LEDs) have the advantage of producing a substantially uniform light from the lighting device. In operation, the LEDs 32 cast light directly onto the back of the lens 60.

Figure 10:
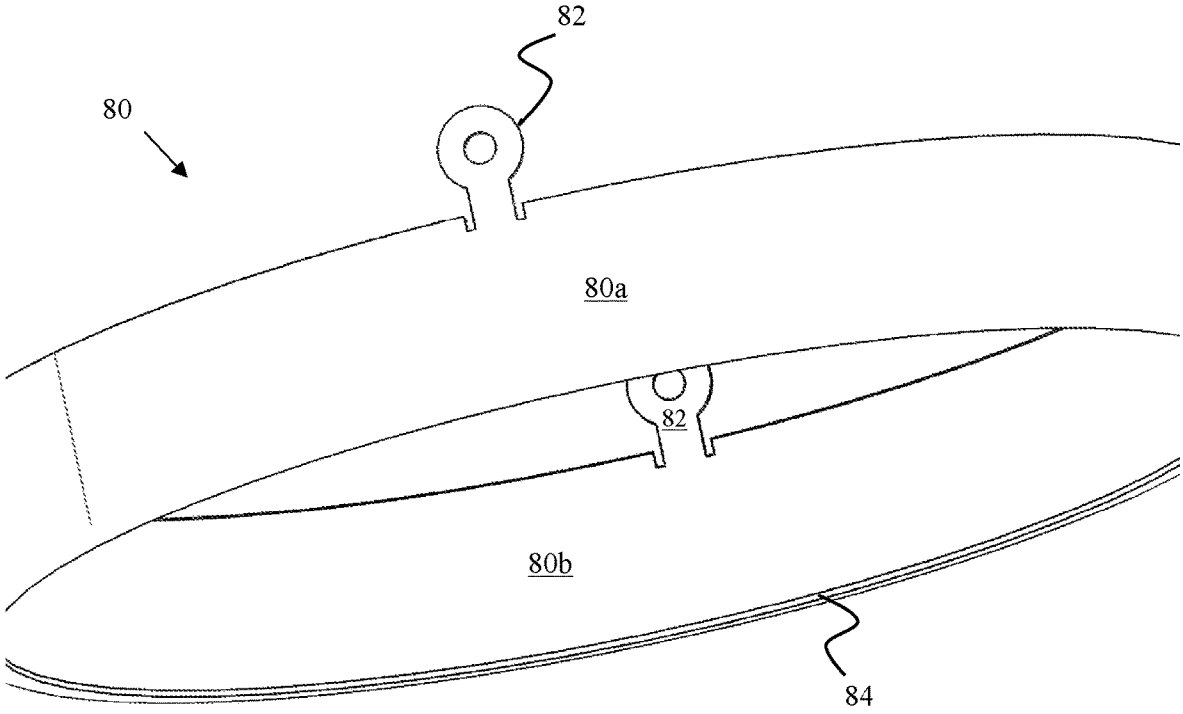
FIG. 10 is drawing showing a isometric partial side view of a removeable trim ring.
Figure 11:
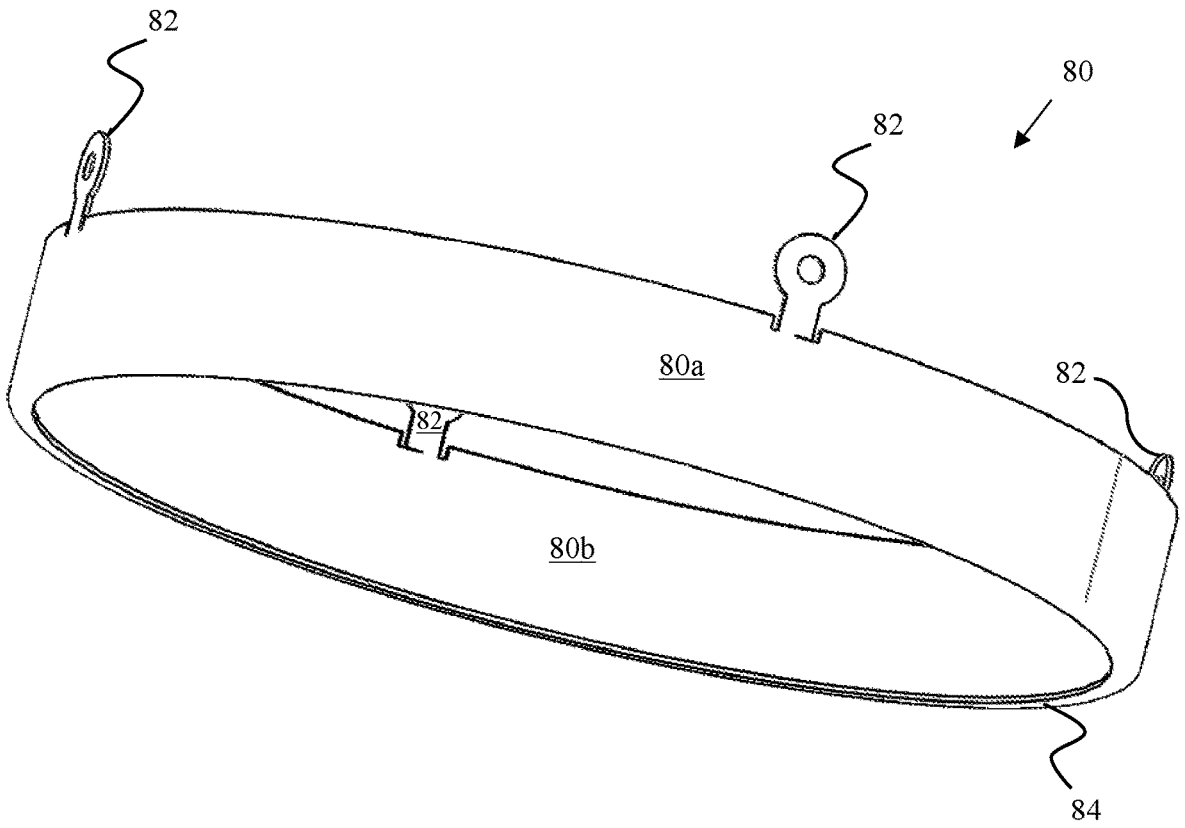
FIG. 11 is drawing showing an alternative isometric side view of a removeable trim ring.

As can be seen in FIGS. 10 and 11, the trim ring 80 has four trim ring tabs 82 extending from the body of the trim ring 80. The body of the trim ring 80 has an inner surface 80*b* and an outer surface 80*a*. In an advantageous embodiment, the trim ring is significantly thin (e.g. 2 mm, 1 mm) and constructed from a malleable or bendable material such as steel or aluminum. Being malleable allows the trim ring tabs to be bent one or more times to facilitate the assembly and installation of the lighting device. While the device is illustrated with 4 trim ring tabs, it is contemplated that the device could be constructed with 1 or more tabs, 2 or more tabs, 3 or more tabs, etc. Further, while the trim ring is illustrated as being round, it is contemplated that the trim ring can adopt a plurality of shapes (e.g. oval, square, rectangular) to match the shape of the lighting device desired. The trim ring 80 as illustrated in FIGS. 10 and 11 also has a an inwardly projecting lip, or trim ring lip 84, at the edge of the trim ring opposite the trim ring tabs 82. The innermost edge of the trim ring lip 84 is dimensioned to be smaller than the outermost edge of the lens 60 that is being secured. This prevents the lens from falling out of the trim ring upon assembly and installation of the lighting device.

Glossary of Claim Terms

As used throughout the entire application, the terms "a" and "an" are used in the sense that they mean "at least one", "at least a first", "one or more" or "a plurality" of the referenced components or steps, unless the context clearly dictates otherwise. For example, the term "a cell" includes a plurality of cells, including mixtures thereof.

The term "and/or" whereever used herein includes the meaning of "and", "or" and "all or any other combination of the elements connected by said term".

The term "about" or "approximately" as used herein means within 20%, preferably within 10%, and more preferably within 5% of a given value or range.

Notwithstanding that the numerical ranges and parameters setting forth the broad scope of the disclosure are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

As used herein, the term "comprising" is intended to mean that the products, compositions and methods include the referenced components or steps, but not excluding others. "Consisting essentially of" when used to define products, compositions and methods, shall mean excluding other components or steps of any essential significance. Thus, a composition consisting essentially of the recited components would not exclude trace contaminants and pharmaceutically acceptable carriers. "Consisting of" shall mean excluding more than trace elements of other components or steps.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

All references cited in the present application are incorporated in their entirety herein by reference to the extent not inconsistent herewith.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A low profile downlight comprising:

a housing comprising a generally planar surface and a sidewall rising from the planar surface;

a printed circuit board (PCB) with a plurality of light emitting diodes (LEDs) affixed to the generally planar surface of the housing;

a lens in contact with the sidewall of the housing and having a first side facing the LEDs on the PCB such that light from the LED illuminates the first side of the lens; and a trim ring adapted to slide over the housing and having a first end and a second end opposite the first end, wherein the first end has a plurality of tabs adapted to secure the trim ring to a housing and the second end has an inwardly projecting lip adapted to contact the second side of the lens thereby securing the lens to the housing.

2. The low profile downlight according to claim 1 wherein the trim ring has a generally cylindrical shape.

3. The low profile downlight according to claim 2 wherein the outer diameter of the lens is less than the inner diameter of the cylindrical section of the trim ring and greater than the diameter of the inner edge of the inwardly projecting lip.

4. The low profile downlight according to claim 1 wherein the tabs comprise a bendable metal that allows the trim ring to releasably engage the housing.

5. The low profile downlight according to claim 1 wherein the plurality of LEDs are arranged in a series of concentric circles on the PCB.

6. The low profile downlight according to claim 1 wherein the diameter of the trim ring is between about 4 inches to about 6 inches.

7. The low profile downlight according to claim 1 wherein the depth of the trim ring excluding the tabs is less than about 4 cm, less than about 3 cm, less than about 2 cm or less than about 1.5 cm.

8. The low profile downlight according to claim 1 wherein the depth of the trim ring excluding the tabs is slightly greater than the combined depth of the edge of the lens and the housing sidewall.

9. The low profile downlight according to claim 1 further comprising a mounting plate adapted to be affixed to an opening of a planar surface and two or more mounting clips that releasably engage the mounting plate.

10. The low profile downlight according to claim 1 wherein the trim ring has a thickness less than about 1 mm.

11. A low profile downlight comprising:

a housing comprising a generally planar surface and a sidewall rising from the planar surface defining the outer periphery of the housing;

a printed circuit board (PCB) with a plurality of light emitting diodes (LEDs) affixed to the generally planar surface of the housing;

a lens in contact with the sidewall of the housing and having a first side facing the LEDs on the PCB such that light from the LED illuminates the first side of the lens and an outer periphery wherein the dimensions of the outer periphery of the lens are approximately equal to the dimensions of the outer periphery of the housing and wherein the lens matingly engages a complementary surface on the housing; and a trim ring adapted to slide over the housing and having a first end and a second end opposite the first end, wherein the first end has a plurality of tabs adapted to secure the trim ring to the housing and the second end has an inwardly projecting lip adapted to contact the second side of the lens thereby securing the lens to the housing.

* * * * *